US005355859A

United States Patent [19]

Weber

[11] Patent Number: 5,355,859

[45] Date of Patent: Oct. 18, 1994

[54] VARIABLE PRESSURE DEADHEADED FUEL RAIL FUEL PUMP CONTROL SYSTEM

[75] Inventor: Robert E. Weber, Newport News, Va.

[73] Assignee: Siemens Automotive L.P., Auburn Hills, Mich.

[21] Appl. No.: 122,117

[22] Filed: Sep. 16, 1993

[51] Int. Cl.[5] ..... F02M 37/04

[52] U.S. Cl. ..... 123/497; 123/490; 123/456

[58] Field of Search ..... 123/497, 494, 357, 456, 123/490

[56] References Cited

U.S. PATENT DOCUMENTS

| | | | |
|---|---|---|---|
| 3,699,931 | 10/1972 | Cinquegrani | 123/497 |
| 4,248,194 | 2/1981 | Drutchas | 123/497 |
| 4,350,132 | 9/1982 | Harsch | 123/490 |
| 4,721,086 | 1/1988 | Scarnera | 123/490 |
| 4,756,291 | 7/1988 | Cummins | 123/497 |
| 4,777,921 | 10/1988 | Miyaki | 123/456 |
| 4,791,905 | 12/1988 | Furuta | 133/497 |
| 5,058,553 | 10/1991 | Kondo | 123/456 |
| 5,133,323 | 7/1992 | Treusch | 123/497 |
| 5,148,792 | 9/1992 | Tuckey | 123/497 |
| 5,186,738 | 2/1993 | Hashimoto | 123/456 |

*Primary Examiner*—Carl S. Miller

*Attorney, Agent, or Firm*—Russel C. Wells; George L. Boller

[57] ABSTRACT

A non-return fuel distribution system or deadheaded fuel distribution system for an internal combustion engine having one or more fuel injectors mounted on a fuel rail on the engine, has a fuel pressure transducer mounted on the fuel rail to sense the fuel pressure in the rail and generate an electrical signal representing such pressure. The electrical signal is combined in a controller to operate an electrically operated variable pressure fuel pump to generate and maintain the fuel pressure necessary to operate the electrically operated fuel injectors in their linear operating pulse range.

2 Claims, 1 Drawing Sheet

10

VARIABLE PRESSURE DEADHEADED FUEL RAIL FUEL PUMP CONTROL SYSTEM

FIELD OF THE INVENTION

This invention relates to an electronic fuel injection systems having a fuel pressure transducer mounted in the fuel rail in general and more particularly to a system for controlling the fuel pump to vary the fuel pressure in a deadheaded, no return, fuel system for extending the dynamic range of a fuel injector.

BACKGROUND OF INVENTION

Prior Art

U.S. Pat. No. 5,133,323 issued to Christopher J. Treusch on Jul. 28, 1992 and assigned to a common assignee, teaches the location of a signal generating fuel pressure sensor mounted on a fuel rail. In that patent, the fuel pressure sensor housing has sensing and circuit means mounted on a platform therein to measure the difference between the manifold absolute pressure (MAP) supplied to one input of the housing and the fuel pressure in the fuel rail as determined by the variable pressure electric fuel pump supplied to another input of the housing. Electrical signals from the sensing and circuit means are supplied to control electronics for generating a signal to drive the electric fuel pump which is located in the fuel tank. The purpose of this system is to maintain the fuel pressure across the injectors at a predetermined value in relationship with MAP. With this predetermined value, the amount of fuel injected into the engine will be a function of the pulse width of the electrical signal generated by the electronic control unit in the fuel management system.

A disadvantage of this prior art system is that the for extreme fuel demand conditions such as full load, the pulse width of the fuel pulse to the injection approaches the maximum available time between injector actuations. Therefore, in order to have the proper amount of fuel available at wide open throttle, the size of the orifice in the injector valve must be of such size to allow the amount of fuel determined by the pulse width and fuel pressure to be sufficient to operate the engine during the maximum pulse width. The disadvantage of this is that at idle and other low power engine conditions, the orifice size requires that the pulse width be very short. Very short pulse widths may be in the non-linear region of the fuel injector operating range.

Summary of the Invention

An important advantage of the present system is that it extends the dynamic range of the fuel supply system. The pulse width of the electrical signal supplied to the fuel injector at idle and other low flow conditions, such as deceleration, is long enough to move out of the non-linear operating region of the fuel injector with a given orifice size. At the same time, at the wide open throttle condition, the injector provides sufficient fuel as determined by the pulse width of the signal to the injector. This is accomplished by varying the differential fuel pressure across the injector.

It is another advantage of the present system to have the fuel pressure sensor mounted on the fuel rail and to sense the fuel pressure across the injectors rather than relying on the fuel pressure regulator mounted on the fuel pump motor in the fuel tank to maintain fuel pressure. By having the fuel pressure sensor in the fuel rail, all of the effects of pressure losses between the fuel tank and the fuel rail caused by flow and temperature effects are eliminated.

It is yet another advantage of the present system to vary, upon demand, the fuel pressure according to a predetermine control law.

Yet another advantage of the present system is that the Electronic Control Unit or ECU has means to compensate for actual, real-time, changes in the pressure differential at the injectors instantaneously during transients in the pressure system.

These and other advantages will become apparent from the variable pressure deadheaded fuel rail fuel pump control system having the fuel rail mounted on an internal combustion engine. The fuel rail has one or more electrically operated fuel injectors mounted thereon operable for discharging fuel from the fuel rail and into the intake system or directly into the combustion chambers of the engine. A plurality of engine operating sensors measure the operational load of the engine. The system controls the pressure of the fuel in the fuel rail for operating the electrically operated fuel injectors in their linear operating range.

A fuel pressure transducer is mounted on the fuel rail and adjacent to the injectors for measuring the absolute pressure of the fuel in the fuel rail. The transducer generates an electrical signal indicating the absolute pressure of the fuel in the fuel rail. A controller is responsive to the electrical signal from the fuel pressure transducer and the engine operating sensors for generating a pump control electrical signal.

An electrically operated variable pressure fuel pump, electrically connected to a variable source of electrical power, is operatively connected to the fuel tank and responds to the pump control electrical signal for pumping fuel under a controlled pressure to the fuel rail. The electrically operated fuel injectors are supplied with fuel under a controlled pressure so as to be operated at all times in the fuel injector's linear operating range of electrical pulse width signals.

These and other advantages will become apparent from the following description of the preferred embodiment of the invention taken in conjunction with the following drawings.

DESCRIPTION OF THE PREFERRED EMBODIMENT

Figure 1:
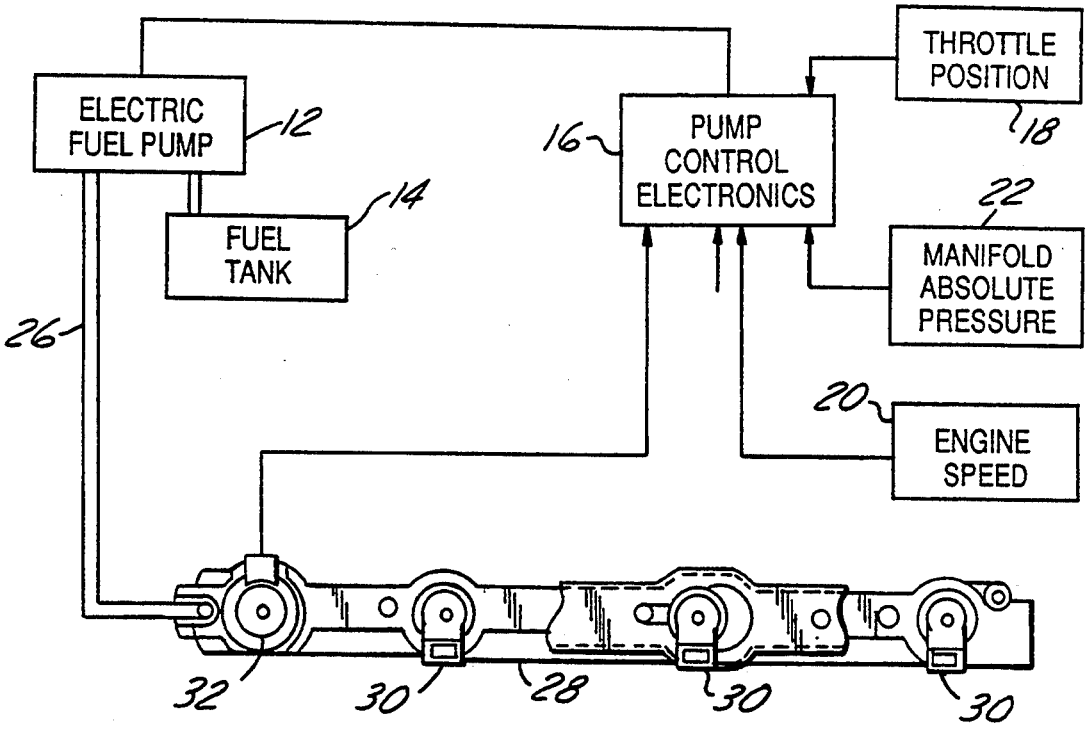
FIG. 1 is a partial schematic plan view of the fuel pump control system.

Referring to FIG. 1, there is illustrated in a partial schematic plan view the fuel pump control system 10 of the preferred embodiment. The fuel pump 12 which is typically mounted in the fuel tank 14 receives power from the pump control electronics or controller 16. The pump control electronics may be located in the Electronic Control Unit or ECU or in a separate control unit.

The controller 16 responds to control signals from several sensors 18, 20, 22 responding to engine operating parameters such as throttle position, engine speed, manifold absolute pressure, etc. The controller 16 provides the proper voltage and current signal, from a source of power 24, to the pump 12 to move fuel from the tank 14 through the fuel lines 26 to the fuel rail 28 mounted on the internal combustion engine, not shown. The pressure of the fuel delivered by the pump 12 is in proportion to the power delivered to the pump. The fuel rail 28 has one or more fuel injectors 30 mounted thereon to discharge fuel under control of the ECU, not shown, in the fuel management system. In addition, mounted on the fuel rail, is a fuel pressure transducer 32 which responds to the absolute fuel pressure in the fuel rail 28 and generates an electrical signal representing the absolute fuel pressure. This absolute fuel pressure electrical signal is supplied to the controller 16.

The advantage of the present system is that the controller 16 can by this means and proper programming, alter and maintain the pressure across the fuel injectors 30 to insure that the proper amount of fuel is delivered to the engine. The accuracy of this system insures that the fuel injectors 30 are always operating within their linear range.

FIG. 1, since there is no fuel return line, illustrates a dead-headed fuel supply system. Fuel once pumped from the fuel tank 14 does not return to the tank. In prior art dead-headed fuel supply systems, the pressure of the fuel is either controlled by a pressure regulator regulating the pressure to a fixed predetermined value in or adjacent to the fuel tank and a pump, or by a sensor measuring the output of the fuel pump in or near in the fuel tank. In such prior art dead-headed systems, any unknown pressure drops, such as that caused by a sharp bend or a kink in the fuel line or caused by temperature differentials are not measured. Therefore, in such timed pulse fuel delivery systems, the amount of fuel to be delivered from the injector into the engine being a function of time the injector is opened and the pressure of the fuel, the amount of fuel will be less because the actual pressure of the fuel at the injector is less due to such fuel line obstructions and temperature differentials.

With the fuel pressure transducer 32 mounted on the fuel rail 28, measurement of the pressure across the injectors 30 is more accurate and certain. The placement of the fuel pressure transducer 32 in the fuel rail with the control electronics operable to vary the fuel pressure, functions to extend the dynamic range of the injectors and hence the fuel system. Each injector 30 can be fabricated with an orifice size which will, at idle speed and other low flow conditions, be within the linear operation of the injector, and will inject the proper amount of fuel to maintain idle stability for engine smoothness and reduction of idle emissions. It has been found that the linear operation range of typical injectors 30 is between 2 milliseconds and 10 milliseconds. Outside of the low end of the range, the operation of the injector is non-linear and the amount of fuel being injected is, at best, variable from injector to injector and could even be substantially zero. Outside the high end of the range, the time between injection events at high speed, heavy load engine conditions for a given cylinder is faster, approaching 10 milliseconds which may be the time required to inject the proper amount of fuel into the engine resulting in a premature closing of the injector.

Figure 2:
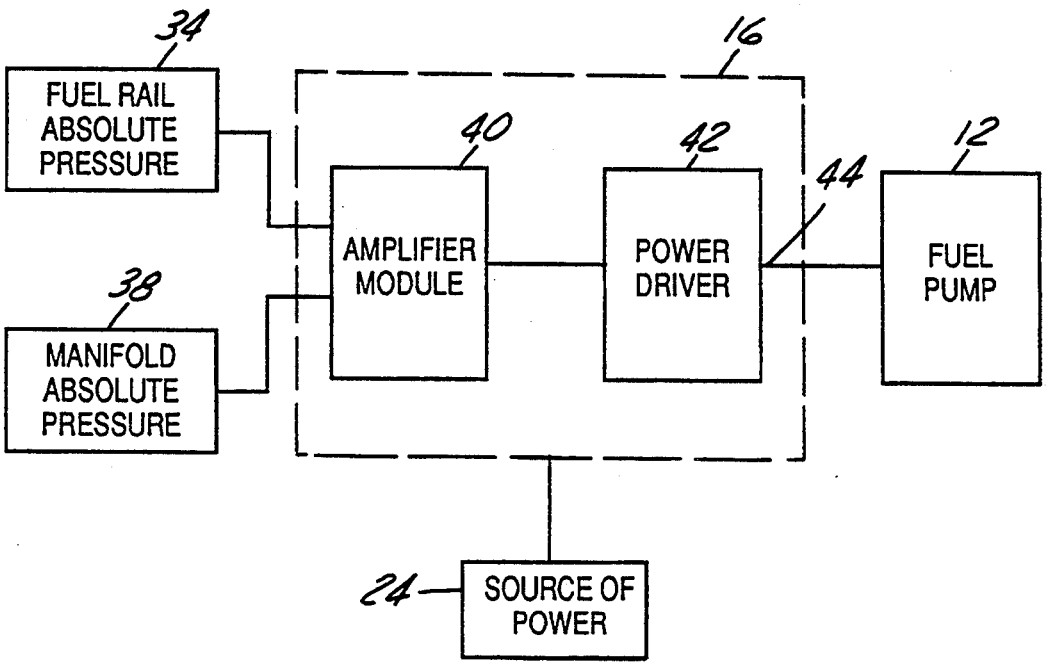
FIG 2 is a block diagram schematic of the fuel pump control electronics of the system of FIG. 1.

Referring to FIG. 2, there is illustrated an block diagram schematic of the pump control electronics of the system of FIG. 1. The fuel pressure transducer 32 generates the fuel rail absolute pressure signal 34 and supplies that signal to an amplifier module 36. Also supplied to the amplifier module 36 are the various engine operating signals including the manifold absolute pressure or MAP signal 38. The output 40 of the amplifier module is an electrical signal which is supplied to a power driver circuit 42 for driving the variable pressure fuel pump 12. The MAP pressure signal 38, along with the other engine operating signals such as throttle position 18, engine temperature and engine rpm 20, define the operational load of the engine. These signals are combined in the amplifier module 40 with the absolute fuel pressure signal 34 to generate an electrical signal to control the pump power driver 42. As previously stated, the output 44 of the pump power driver 42 is a signal which operates the variable pressure fuel pump 12.

The fuel delivery from most solenoid operated fuel injectors 30 is controlled by the amount of time that they are actuated or open and the pressure differential of the fuel across them. The ECU determines the pulse width of the signal supplied to operate the injector to open the valve. If the engine is operating at a heavy load, the amount of fuel to be injected is much more than if the engine is operating at a light load. The size of the orifice in the fuel injector 30 is a fixed mechanical means to control the rate of fuel flowing from the injector. The time length of the fuel pulse is controlled by an electrical or electronic means to control the amount of fuel being injected. The amount of pressure that the fuel is under controls the quantity of fuel being injected for the size of the orifice and the time length of the fuel pulse.

As previously stated, all of the fuel supplied to the fuel rail 28 is injected into the engine and none of the fuel is returned to the fuel tank 14. With the fuel pressure sensor/transducer 32 located on the fuel rail 28, the actual pressure of the fuel at the injectors 30 is measured taking into account any pressure drops or losses in the fuel handling system between the fuel pump 12, typically located at the back of the motor vehicle, and the fuel rail 28 which is typically located at the front of the vehicle.

There has thus been illustrated a variable pressure deadheaded fuel rail fuel pump control system 10 used in an internal combustion fuel distribution system having a fuel pressure transducer 32 located away from the fuel pump 12 and on the fuel rail 28 adjacent to the injectors 30. The advantages of such a system are numerous but most importantly the actual pressure of the fuel immediately prior to injection is measured and controlled so that the injectors 30 are programmed to operate in linear regions of actuation.

These and other advantages will become apparent from the fuel system having a fuel pump 12, such as an intank mounted fuel pump, for pumping fuel from the fuel tank 14 to the fuel injectors 30 mounted in a fuel rail 28. The fuel pump 12 is driven by a pump control electronics or controller 16 which is capable of varying the operation of the fuel pump 12 to change the pressure of the fuel leaving the tank 14. An absolute fuel pressure sensor/transducer 32 is mounted in the fuel rail 28 adjacent to one or more fuel injectors 30 and is responsive to the pressure of the fuel in the fuel rail. The fuel pressure sensor 32 generates an electrical signal indicating the absolute pressure of the fuel in the fuel rail 28. The controller 16 then compares this electrical signal 34 to the MAP signal 38 and other engine operating signals to calculate the correct fuel pressure by predetermined rules stored in the ECU or controller 16. The controller 16 will then generate a signal to the fuel pump 12 to varying the power to the fuel pump until the fuel pressure in the fuel rail 28 is as measured by the fuel pressure transducer 32 as required by the engine management system. Thus, the fuel pressure across the injectors 30 will be such that the electronic control unit will generate a fuel pulse width of sufficient size to the injector in order to operate the injector in its linear operating region.

I claim:

1. In variable pressure deadheaded fuel rail fuel pump control system having the fuel rail mounted on an internal combustion engine, the fuel rail having one or more electrically operated fuel injectors mounted thereon and operable for discharging fuel from the fuel rail and into the engine, a plurality of engine operating sensors for measuring the operational load of the engine and calculating the open time of the injector, wherein the improvement comprises:

means for comparing the calculated open time of the injector with the linear operating time of the injector;

means responsive to said comparison and generate a first fuel pump control signal if said calculated open time is within the linear operating time of the injector and to modify the calculated open time if such time is not within the linear operating time of the injector to generate a second fuel pump control signal;

a fuel pump control system responding to said fuel pump control signals for controlling the output pressure of the fuel from the fuel pump to the fuel rail for operating the electrically operated fuel injectors in their linear operating range, the system further comprising;

a fuel pressure transducer mounted on the fuel rail and adjacent to the injectors for measuring the absolute pressure of the fuel in the fuel rail, and for generating an electrical signal indicating the pressure of the fuel;

means for comparing the calculated open time of the injector with the linear operating time of the injector;

means responsive to said comparison and generate a first signal if said calculated open time is within the linear operating time of the injector and to modify the calculated open time if such time is not within the linear operating time of the injector to generate a second signal;

means responsive to said electrical signal from said fuel pressure transducer and one of said first or second signals for generating a pump electrical signal;

an electrically operated variable pressure fuel pump operatively connected to the fuel tank and responsive to said pump electrical signal for pumping fuel under pressure to the fuel rail;

so that the electrically operated fuel injectors are supplied with fuel under sufficient pressure to be operated at all times in the fuel injector's linear operating range of electrical pulse width signals.

2. A fuel pump controller for a variable pressure deadheaded fuel rail for an internal combustion engine comprising:

a means for measuring the fuel pressure at the fuel rail and generating a fuel pressure electrical signal;

a means for measuring at least one engine operating parameter of the engine and generating an injector actuating electrical signal having a pulse width in response thereto;

means for comparing the calculated open time of said injector actuating signal with the linear operating time of the injector;

means responsive to said comparison and generate a first signal if said calculated open time is within the linear operating time of the injector and to modify the calculated open time if such time is not within the linear operating time of the injector to generate a second signal;

an amplifier means responsive to said fuel pressure electrical signal and one of said first or second signals for generating a pump control signal;

power driver means responsive to said pump control signal for generating a power electrical signal; and a variable pressure electric fuel pump responsive to said power electrical signal for pumping fuel from a fuel tank to the fuel rail at a pressure to maintain a predetermined fuel pressure in the fuel rail.

* * * * *